US005478245A

United States Patent [19]

Okada et al.

[11] Patent Number: 5,478,245

[45] Date of Patent: Dec. 26, 1995

[54] WATERPROOF ELECTRICAL CONNECTOR WITH SUCTION MECHANISM

[75] Inventors: Hajime Okada; Hikaru Itou, both of Yokkaichi, Japan

[73] Assignee: Sumitomo Wiring Systems, Ltd., Mie Pref., Japan

[21] Appl. No.: 245,901

[22] Filed: May 19, 1994

[30] Foreign Application Priority Data

May 28, 1993 [JP] Japan ..... 5-151502

[51] Int. Cl.[6] ..... H01R 13/44

[52] U.S. Cl. ..... 439/41

[58] Field of Search ..... 439/41, 42, 205, 439/206, 198, 197

[56] References Cited

U.S. PATENT DOCUMENTS 4,793,819 12/1988 Berg ..... 439/205

FOREIGN PATENT DOCUMENTS 4-124774 11/1992 Japan .

1254531 11/1971 United Kingdom ..... 439/42

*Primary Examiner*—Gary F. Paumen

*Attorney, Agent, or Firm*—Wenderoth, Lind & Ponack

[57] ABSTRACT

An electrical connector includes a connector housing having a drain hole. A vacuum pump is connected to the drain hole through a suction pipe. The suction pipe is connected to a water trap. A control unit controls the vacuum pump on the basis of the state of a mode selecting switch and a reed switch detecting the state of a lid for closing and opening an open end of the connector housing. In mode A, the vacuum pump is actuated to aspirate water from in the connector housing with air while the lid is open. In mode B, the vacuum pump is actuated both when the lid is opened and when the lid is closed.

9 Claims, 3 Drawing Sheets

WATERPROOF ELECTRICAL CONNECTOR WITH SUCTION MECHANISM

BACKGROUND OF THE INVENTION

1. Field of the Invention

This invention relates to an electrical connector of the type wherein terminals are enclosed deep in a connector housing having a depressed portion and a counterpart connector is inserted into the depressed portion so that the terminals are mated with those of the counterpart connector respectively, and more particularly to such an electrical connector suitable for use in places, such as the outdoors, where the connector is subjected to rain or other water drops.

2. Description of the Prior Art

The prior art has provided various types of electrical connectors suitable for use in places, such as the outdoors, where the connectors are subjected to rain drops. One of such connectors includes a waterproof cap mounted to close and open an opening of a connector housing. The waterproof cap is attached to the connector housing to close its opening when the connector is not used while the cap is detached from the connector housing so that the connector is mated with a counterpart connector when the connector is used. In the case where the rain drops have invaded the connector housing, the rain drops are wiped away with cloth or the like and then, the connectors are mated.

In the above-described conventional connector, the rain drops needs to be wiped away with the cloth when invading the connector housing in the case where the waterproof cap is detached from the connector housing. However, since terminals are provided in the connector housing, it is difficult to wipe the rain drops away with the cloth. Furthermore, there is a possibility that other rain drops may invade the connector housing while the rain drops are being wiped away.

SUMMARY OF THE INVENTION

Therefore, an object of the present invention is to provide an electrical connector wherein the water having invaded the connector housing can be efficiently discharged.

The present invention provides an electrical connector which is mated with a counterpart connector, comprising a connector housing having a depressed portion into which the counterpart connector is inserted and an opening, terminals disposed deep in the connector housing so as to be connected to terminals of the counterpart connector, respectively, and a suction mechanism communicating with the interior of the connector housing.

The water in the connector housing is aspirated by the suction mechanism communicating with the interior of the connector housing. Since the water is aspirated out of the connector housing in a positive manner, the water can be efficiently discharged.

Moreover, the suction mechanism may be operated continuously for a predetermined period of time. Accordingly, no water is left in the connector housing.

Further, another object of the invention is to provide an electrical connector wherein the aspiration of the water from the connector housing can be automated so that various causes for the invasion of the water into the connector housing are coped with.

To achieve this object, the electrical connector further comprises a lid for closing and opening the connector housing, a sensor for detecting closure and opening of the lid and control means for controlling the suction mechanism on the basis of the result of detection by the sensor.

The water tends to invade the connector housing when the lid is opened. The suction mechanism is automatically operated when the lid is opened. Accordingly, the suction mechanism will be operated before a large amount of water invades the connector housing.

Still another object of the invention is to provide an electrical connector wherein the water having invaded the connector housing can be efficiently discharged when the lid is opened and closed.

To achieve this object, the control means actuates the suction mechanism on the basis of the result of detection by the sensor. Specifically, the suction mechanism is operated when the lid is opened and stopped when the lid is closed. Thus, the suction mechanism can be automatically operated only when there is a possibility that the water may invade the connector housing.

Alternatively, the control means may control the suction mechanism so that the suction mechanism is operated for a predetermined period of time after the lid has been closed. In this control, the suction mechanism is not stopped immediately when the lid is closed but is operated for the predetermined period of time even after the closure of the lid so that the remaining water is discharged. Consequently, water can be prevented from remaining in the connector housing.

The control means may in fact operate the suction mechanism for a short predetermined period of time both when the lid has been opened and when the lid has been closed. Even when the lid is opened, it is difficult for external water to invade the connector housing while the counterpart connector is being inserted into the connector housing. Accordingly, the suction mechanism need not be operated during this time. However, the counterpart connector is not located inside the connector housing for a short period of time after the lid has been opened and for a short period of time before the lid is closed. The suction mechanism is thus operated during these short periods of time.

The foregoing description has been directed to the closure and opening of the lid as the cause of the invasion of water. Insertion of the counterpart connector into the connector housing is another cause of water invasion.

Accordingly, another object of the invention is to provide an electrical connector which automatically operates the suction mechanism when the insertion of the counterpart connector is detected.

To achieve this object, the electrical connector further comprises a connector sensor detecting the insertion of the counterpart connector into the connector housing and the withdrawal of the counterpart connector from the connector housing, wherein the control means controls the suction mechanism on the basis of the result of detection by the connector sensor.

Water easily invades the connector housing when the counterpart connector is mated with the connector. Accordingly, the insertion of the counterpart connector into the connector housing is detected so that the suction mechanism is controlled. As a result, the suction mechanism is operated before a large amount of water invades the connector housing.

Specifically, the control means actuates the suction mechanism when the counterpart connector has been inserted into the connector housing and stops the suction mechanism when the counterpart connector has been pulled out of the connector housing. In this control, the suction mechanism is automatically operated only when there is a possibility that the water may invade the connector housing.

Alternatively, the control means may operate the suction mechanism for a predetermined period of time after the counterpart connector has been pulled out of the connector housing.

In this control, the suction mechanism is not stopped immediately when the counterpart connector is pulled out of the connector housing but is operated for a predetermined period of time, so that any water remaining in the connector housing is discharged.

Moreover, the control means may operate the suction mechanism for a predetermined period of time both when the counterpart connector has been inserted into the connector housing and when the counterpart connector has been pulled out of the connector housing. It is difficult for external water to invade the connector housing while the counterpart connector is located in the connector housing. Thus, the suction mechanism is operated for only a short period of time after both the insertion of the counterpart connector and withdrawal of the counterpart connector.

BRIEF DESCRIPTION OF THE DRAWINGS

Other objects, features and advantages of the present invention will become clear upon reviewing the following description of the preferred embodiments thereof, made with reference to the accompanying drawings, in which.

DETAILED DESCRIPTION OF THE PREFERRED EMBODIMENTS

Figure 1:
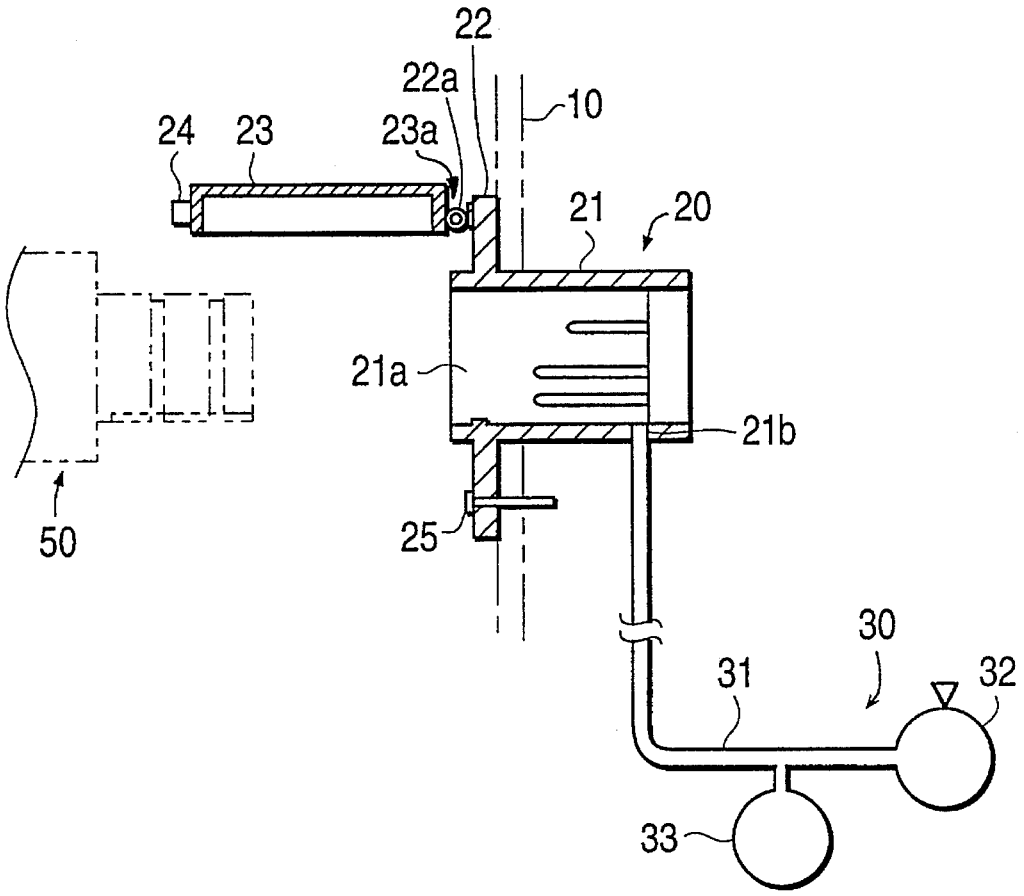
FIG. 1 is a schematic sectional view of a first embodiment of an electrical connector in accordance with the present invention.
Figure 2:
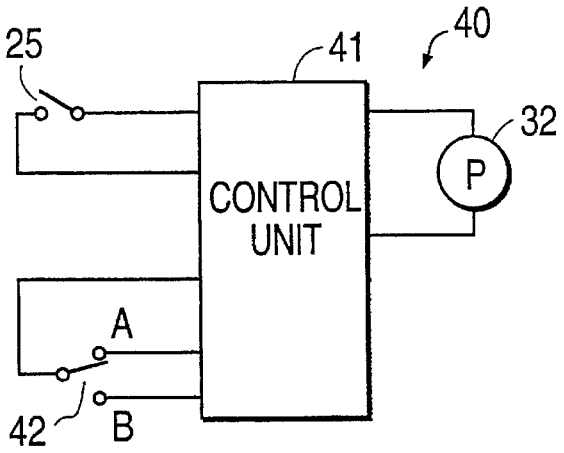
FIG. 2 is a block diagram of an electrical system of the connector.

A first embodiment of the present invention will be described with reference to FIGS. 1 to 3 of the accompanying drawings. In the embodiment, the electrical connector is applied to a charging connector used for charging a power battery of an electric vehicle.

The charging connector 20 is mounted on a body 10 of the electric vehicle. The connector 20 comprises a cylindrical connector housing 21 having an opening 21*a* at one end thereof and a flange 22 extending from one side of the connector housing 21 in the vicinity of the opening thereof. A lid 23 is mounted on a hinge portion 22*a* mounted on the flange 22 for closing and opening the opening 21*a*. A magnet 24 is mounted on an end of lid 23 opposite a hinge portion 23*a* paired with the hinge portion 22*a*. A reed switch 25 serving as a lid sensor is provided for detecting closure and opening of the lid 23. The reed switch 25 is mounted on a portion of the flange 22 facing the magnet 24 when the opening 21*a* of the connector housing 21 is closed by the lid 23. The reed switch 25 is turned on when the lid 23 is closed such that the magnet 24 comes close thereto.

The connector housing 21 has a drain hole 21*b* formed in its deep inner periphery. One end of a suction pipe 31 of a suction mechanism 30 is connected to the drain hole 21*b*. The other end of the suction pipe 31 is connected to a vacuum pump 32. The suction pipe 31 is further connected to a tank-like water trap 33 at its middle.

The reed switch 25 and the vacuum pump 32 are connected to a control section 40. The control section 40 comprises a built-in central processing unit (CPU) for monitoring the results of detection by the reed switch 25 and a control unit 41 for controlling the supply of power to the vacuum pump 32. A mode switch 42 for selecting one of operation modes is connected to the control unit 41. The control unit 41 executes a control in the manner shown in FIG. 3 in accordance with the operation mode selected with the mode switch 42. A charge connector 50 serving as a counterpart connector is inserted into the connector housing 21 to be mated with the connector 20.

The operation of the connector will now be described. Assume that the mode A is selected with the mode switch 42. At step 100, the control unit 41 detects a change in the state of the reed switch, namely ON or OFF. The lid 23 is closed at first and accordingly, the reed switch 25 is maintained in the ON-state. Consequently, the control unit 41 repeats execution of step 100 in a loop.

The magnet 24 departs from the reed switch 25 in an arc when an operator opens the lid 23 mounted on the body 10 of the electric vehicle so that the power battery thereof is charged. Consequently, the reed switch 25 is turned off. Then, the control unit 41 determines that the state of the reed switch 25 has been changed, advancing to step 102. The control unit 41 detects the state of the mode switch 42 at step 102. Since mode A has been selected as described above, the control unit 41 advances to step 104 where it determines whether the reed switch 25 is in the OFF-state. That the reed switch is in the OFF-state after a change in its state indicates that the reed switch 25 has been changed from the ON-state to the OFF-state. This change of the state of the reed switch indicates that the lid 23 has been opened. Then, the control unit 41 starts up the vacuum pump 32 at step 106. Upon operation of the vacuum pump 32, negative pressure is supplied through the suction pipe 31 to the drain hole 21*b* deep in the connector housing 21.

Rain drops invade the connector housing 21 when it is raining or those adherent on the body 10 of the electric vehicle fall into the connector housing 21. Since air is sucked in toward the deep interior of the connector housing 21, the rain drops are also sucked in with the air. The air and the rain drops are caused to flow through the suction pipe 31 toward the vacuum pump 31. Only rain drops having a large mass are taken into the water trap 33 and the air is exhausted through the vacuum pump 32.

The control unit 41 returns to step 100 where it determines whether the state of the reed switch 25 has been changed or not, after the vacuum pump 32 has been started at step 106. The reed switch 25 is maintained in the OFF-state while the lid 23 is open. Accordingly, the control unit 41 repeats execution of step 100 in the loop.

On the other hand, the charge connector 50 is inserted into the connector housing 21 so that charging is initiated. The charge connector 50 is pulled out of the connector housing 21 and the lid 23 is closed when charging is completed after the lapse of a predetermined period of time. Then, the magnet 24 mounted on the lid 23 comes close to the reed switch 25 such that it is turned on. The control unit 41 detects this change of the state of the reed switch 25 at step 100.

Subsequently, the control unit 41 advances from step 102 to step 104 where it determines whether the reed switch 25 is in the OFF-state or not. Since the lid 23 is closed as described above, the reed switch 25 is in the ON-state. Accordingly, the control unit 41 advances to step 108 where a delay operation is executed for a predetermined period of time. The vacuum pump 32 is stopped upon the lapse of the predetermined period of time at step 110. When the lid is closed, there is no possibility that the rain drops may invade the connector housing 21. However, the vacuum pump 32 is operated for the predetermined period of time so that the water drops having already invaded the connector housing 21 are drawn into suction pipe 31. The vacuum pump 32 is stopped when the water drops have been completely discharged. The predetermined period of time may be fixed or may be lengthened according to a period of time for which the lid is open. Thereafter, the control unit 41 repeats step 100, awaiting the change of state of the reed switch 25.

The rain drops or the water drops adherent to the charge connector 50 are likely to invade the connector housing 21 while the lid 23 is open. The vacuum pump 32 is operated while the lid 23 is open, so that the water in the connector housing 21 is discharged therefrom.

Assume now that mode B is selected with the mode switch 42. The reed switch 25 changes from the ON-state to the OFF-state when the lid 23 is opened. The control unit 41 detects the change of state of the reed switch 25 at step 100 and then advances to step 102 where the state of the mode switch 25 is detected. Confirming selection of mode B, the control unit 41 advances to step 112 where the vacuum pump 32 is operated. Thereafter, the control unit 41 advances to step 108 where the delay operation is executed. Then, the control unit 41 advances to step 110 where the vacuum pump 32 is stopped.

When the lid 23 is opened so that the power battery of the electric vehicle is charged, the opening 21*a* of the connector housing 21 is kept open until the charge connector 50 is inserted into the connector housing 21. The opening 21*a* is closed upon insertion of the charge connector 50. After closure of the opening 21*a*, the water cannot invade the connector housing 21. The charge connector 50 is promptly inserted into the connector housing 21 when the lid 23 is opened. A period of time between opening of the lid 23 and insertion of the charge connector 50 is generally fixed. Accordingly, the vacuum pump 32 is operated for a predetermined period of time after the lid 23 is opened. Consequently, the water can be aspirated during the period in which the water is likely to invade the connector housing 21.

Upon completion of charging, the charge connector 50 is pulled out of the connector housing 21 and the lid 23 is closed. The reed switch 25 then changes from the OFF-state to the ON-state. The control unit 41 advances from step 102 to step 112 where the vacuum pump 32 is actuated. Then, the delay operation is executed at step 108 and then, the vacuum pump 32 is stopped at step 110. Since the charge connector 50 has been pulled out before the lid 23 is closed, the opening 21*a* of the connector housing 21 is open. The water invading the connector housing 21 during the open state of the opening 21*a* is discharged by the vacuum pump 32.

The opening 21*a* is open before the lid 23 is closed and after the lid 23 is opened. The rain drops and the water drops adherent to the charge connector 50 are likely to invade the connector housing 21 in these periods. The vacuum pump 32 is operated before the lid 23 is closed and after the lid 23 is opened, so that the water in the connector housing 21 is discharged.

Figure 4:
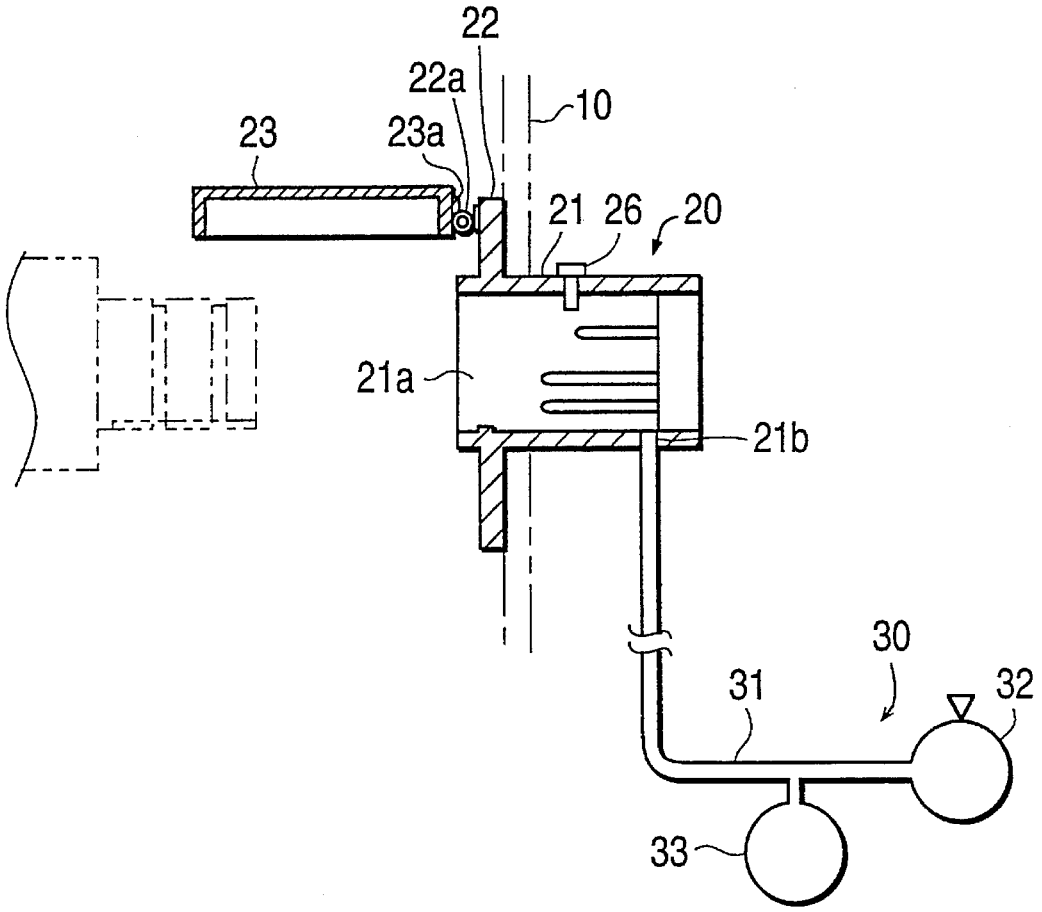
FIG. 4 is a schematic sectional view of a second embodiment of an electrical connector in accordance with the present invention.
Figure 5:
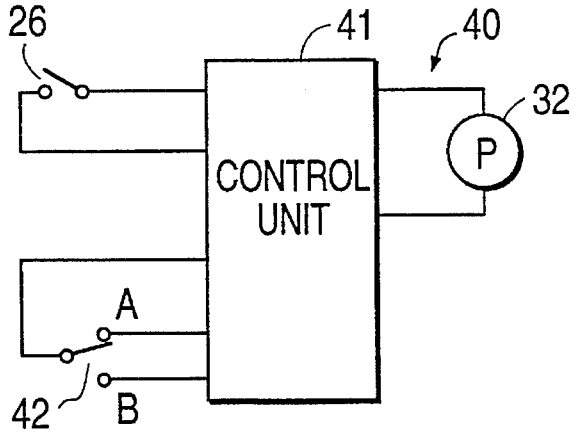
FIG. 5 is a block diagram of an electrical system of the second embodiment.

In the foregoing embodiment, the control unit 41 controls the vacuum pump 41 on the basis of the results of detection by the reed switch 25 detecting the state of the lid 23 closing and opening the opening 21*a* of the connector housing 21. Instead, a microswitch 26 may be provided for detecting insertion of the charge connector 50 into the connector housing 21, as in a second embodiment shown in FIGS. 4 and 5 . The microswitch 26 is turned off when the charge connector 50 has been inserted into the connector housing 21. The control unit 41 may control the vacuum pump 32 on the basis of the change in the state of the microswitch 26.

Figure 3:
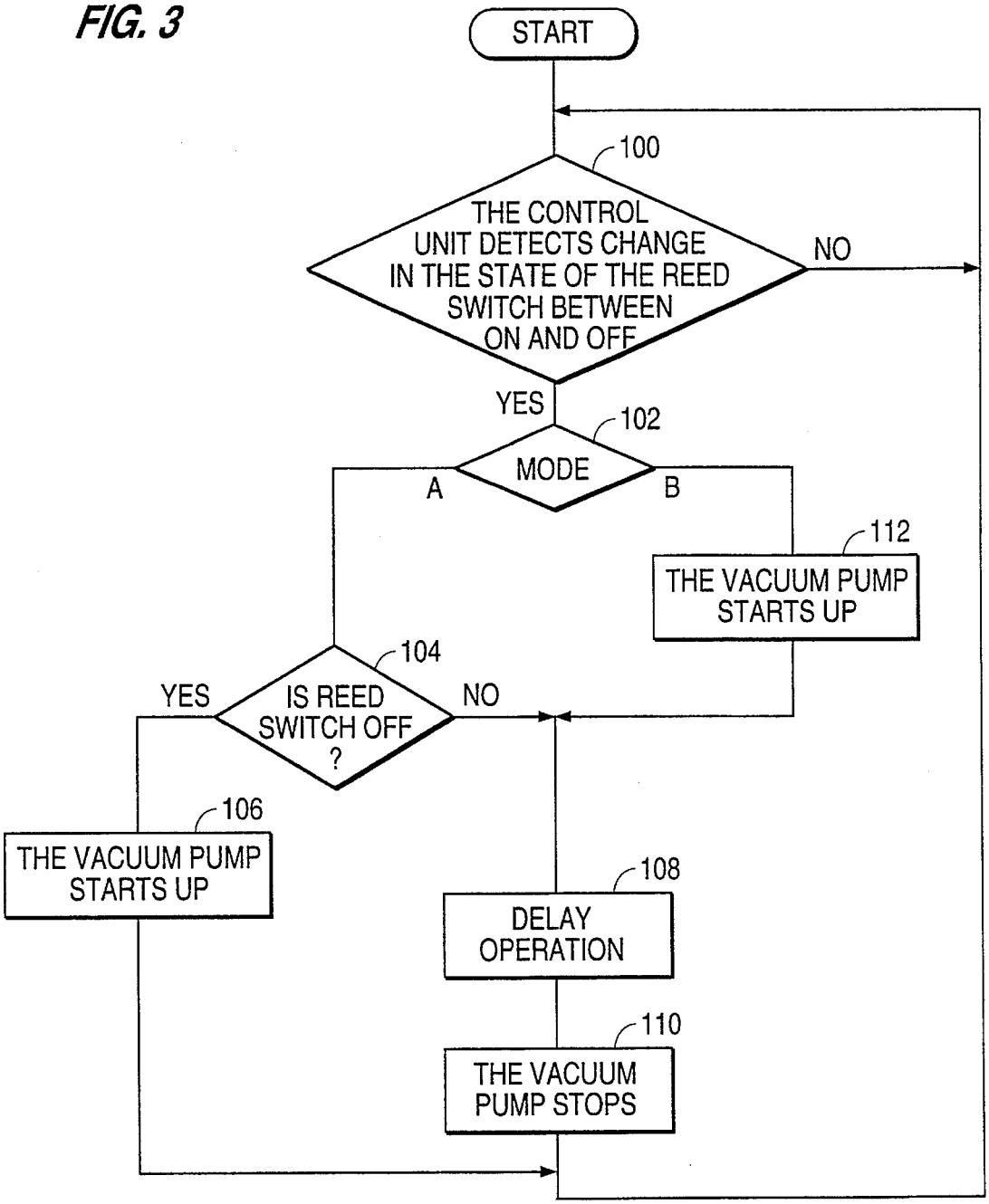
FIG. 3 is a flowchart showing the operation of a control unit employed in the connector.

In the control operation, the reed switch is replaced by the microswitch in the flowchart of FIG. 3. In mode A, the operation of the vacuum pump 32 is initiated when the charge connector 50 has been inserted into the connector housing 21. The vacuum pump 32 is operated until the predetermined period of time elapses after the charge connector 50 has been pulled out of the connector housing 21. Since the opening 21*a* of the connector housing 21 is open before the charge connector is inserted into the connector housing 21, the water is likely to invade the connector housing 21. Accordingly, the vacuum pump 32 is operated when the charge connector 50 has been inserted into the connector housing 21, so that the water in the connector housing 21 can be discharged.

In mode B, the vacuum pump 32 is operated for the predetermined period of time after the charge connector 50 is inserted into and pulled out of the connector housing 21. Since the opening 21*a* is open when the charge connector 50 is inserted into and pulled out of the connector housing 21, the water is likely to invade the connector housing 21. Accordingly, the vacuum pump 32 is operated after the charge connector 50 is inserted into and pulled out of the connector housing 21 so that the water in the connector housing 21 can be discharged.

Although the control of the control unit 41 is based on the result of detection by the reed switch 25 or the microswitch 26, these switches may be combined so that the vacuum pump 32 is operated while the lid 23 is open without insertion of the charge connector 50.

The foregoing description and drawings are merely illustrative of the principles of the present invention and are not to be construed in a limiting sense. Various changes and modifications will become apparent to those of ordinary skill in the art. All such changes and modifications are seen to fall within the true spirit and scope of the invention as defined by the appended claims.

We claim:

1. An electrical connector which is to be mated with a counterpart connector having terminals, said electrical connector comprising: a connector housing having an opening and a cavity into which the counterpart connector is to be inserted through said opening, terminals disposed at an end of said cavity in the connector housing so as to be connected to terminals of the counterpart connector, respectively, a vacuum pump communicating with said cavity of the connector housing, and a timer operated when the vacuum pump is actuated.

2. An electrical connector which is to be mated with a counterpart connector having terminals, said electrical connector comprising: a connector housing having an opening and a cavity into which the counterpart connector is to be inserted through said opening, terminals disposed at an end of said cavity in the connector housing so as to be connected to terminals of the counterpart connector, respectively, a vacuum pump communicating with said cavity of the connector housing, a lid provided to close and open the opening of the connector housing, sensor means for detecting closure and opening of the lid, and control means for controlling the vacuum pump on the basis of the result of detection by the sensor.

3. An electrical connector according to claim 2, wherein the control means actuates the vacuum pump when the lid has been opened and stops the vacuum pump when the lid has been closed.

4. An electrical connector according to claim 2, wherein the control means actuates the vacuum pump when the lid has been opened and stops the vacuum pump upon the lapse of a predetermined period of time after the lid as been closed.

5. An electrical connector according to claim 2, wherein the control means operates the vacuum pump for a predetermined period of time both when the lid has been opened and when the lid has been closed.

6. An electrical connector which is to be mated with a counterpart connector having terminals, said electrical connector comprising: a connector housing having an opening and a cavity into which the counterpart connector is to be inserted through said opening, terminals disposed at an end of said cavity in the connector housing so as to be connected to terminals of the counterpart connector, respectively, a vacuum pump communicating with said cavity of the connector housing, and connector sensor means for detecting an insertion of the counterpart connector into the connector housing and a withdrawal of the counterpart connector from the connector housing, and wherein said control means controls the vacuum pump based on the result of detection by the connector sensor means.

7. An electrical connector according to claim 6, wherein the control means actuates the vacuum pump when the counterpart connector has been inserted into the connector housing and stops the vacuum pump when the counterpart connector has been pulled out of the connector housing.

8. An electrical connector according to claim 6, wherein the control means actuates the vacuum pump when the counterpart connector is inserted into the connector housing and stops the vacuum pump after the lapse of a predetermined period of time after the counterpart connector has been withdrawn from the connector housing.

9. An electrical connector according to claim 6, wherein the control means actuates the vacuum pump for a predetermined period of time both when the counterpart connector has been inserted into the connector housing and when the counterpart connector has been withdrawn from the connector housing.

* * * * *